US011749910B2

(12) United States Patent
Kenkel

(10) Patent No.: US 11,749,910 B2
(45) Date of Patent: Sep. 5, 2023

(54) DUAL BAND ANTENNA

(71) Applicant: Shure Acquisition Holdings, Inc., Niles, IL (US)

(72) Inventor: Mark Allen Kenkel, Schaumburg, IL (US)

(73) Assignee: Shure Acquisition Holdings, Inc., Niles, IL (US)

( * ) Notice: Subject to any disclaimer, the term of this patent is extended or adjusted under 35 U.S.C. 154(b) by 0 days.

(21) Appl. No.: 17/480,665

(22) Filed: Sep. 21, 2021

(65) Prior Publication Data

US 2022/0131280 A1 Apr. 28, 2022

Related U.S. Application Data

(63) Continuation of application No. 16/727,631, filed on Dec. 26, 2019, now Pat. No. 11,158,958.

(51) Int. Cl.
*H01Q 21/30* (2006.01)
*H01Q 21/28* (2006.01)

(52) U.S. Cl.
CPC ..... *H01Q 21/30* (2013.01); *H01Q 21/28* (2013.01)

(58) Field of Classification Search
CPC ..... H01Q 21/30; H01Q 21/28; H01Q 5/49; H01Q 1/38; H01Q 1/2291; H01Q 19/30;
(Continued)

(56) References Cited

U.S. PATENT DOCUMENTS 4,071,846 A 1/1978 Oltman, Jr.
6,232,923 B1 5/2001 Guinn et al.
(Continued)

FOREIGN PATENT DOCUMENTS

CN 102110897 A 6/2011
CN 102842753 A 12/2012
(Continued)

OTHER PUBLICATIONS

Jones et al., "Design of Yagi-Uda Antenna Using Genetic Algorithms" (Year: 1997).*
(Continued)

*Primary Examiner* — Thien T Mai
(74) *Attorney, Agent, or Firm* — Banner & Witcoff, Ltd.

(57) ABSTRACT

A dual band antenna that allows the independent optimization of each frequency band by adjusting the sizes of the antenna elements. For example, an antenna may have two different drivers, one for the high-frequency and one for the low frequency. By using elements orthogonally connected to the low frequency driver, the low frequency driver can function as both a reflector to the high frequency drivers and the low frequency driver without affecting the antenna's performance in the high frequency. The antenna may also have parasitic elements. For example, parasitic directors parallel to the high frequency band driver can be configured to improve performance in the high frequency band. Pairs of additional parasitic directors can be orthogonally connected these directors. These pairs can be adjusted in size to improve performance in the low frequency band with minimal impact on performance in the high frequency band.

20 Claims, 7 Drawing Sheets

(58) Field of Classification Search
CPC ..... H01Q 21/064; H01Q 1/48; H01Q 21/24; H01Q 3/16; H01Q 3/18; H01Q 3/20
See application file for complete search history.

(56) References Cited

U.S. PATENT DOCUMENTS

| | | | | |
|---|---|---|---|---|
| 6,320,542 | B1 | 11/2001 | Yamamoto et al. | |
| 7,215,285 | B2 | 5/2007 | Song et al. | |
| 7,274,339 | B2 | 9/2007 | Wu et al. | |
| 7,289,068 | B2 | 10/2007 | Fujio et al. | |
| 7,295,162 | B2 | 11/2007 | Wang et al. | |
| 7,321,333 | B2 | 1/2008 | Tsai et al. | |
| 7,369,094 | B2 | 5/2008 | Song et al. | |
| 7,417,588 | B2 | 8/2008 | Castany et al. | |
| 7,639,185 | B2 | 12/2009 | Mei | |
| 8,049,671 | B2 | 11/2011 | Nysen | |
| 8,063,845 | B2 | 11/2011 | Rabinovich | |
| 8,462,072 | B2 | 6/2013 | Andrenko et al. | |
| 8,519,891 | B2 | 8/2013 | Chen | |
| 11,050,470 | B1 * | 6/2021 | Frigon | H04B 7/0617 |
| 2003/0201944 | A1 * | 10/2003 | Aikawa | H01Q 21/064 343/770 |
| 2006/0273976 | A1 | 12/2006 | Wang et al. | |
| 2011/0090131 | A1 | 4/2011 | Chen et al. | |
| 2016/0197405 | A1 * | 7/2016 | Higaki | H01Q 21/065 343/852 |

FOREIGN PATENT DOCUMENTS

| | | | | |
|---|---|---|---|---|
| CN | 205141137 | U | 4/2016 | |
| CN | 207852919 | U | 9/2018 | |
| DE | 2047315 | A1 | 12/1971 | |
| WO | WO-2014091458 | A2 * | 6/2014 | H01Q 21/30 |

OTHER PUBLICATIONS

S.S. Khade et al, Yagi Uda Antenna with Integrated Balun for WLAN Application, International Journal of Computer Applications (0975-8887), International Conference on Reliability, Infocom Technologies and Optimization, 2013, pp. 21-24.

Feb. 24, 2021—(WO) International Search Report and Written Opinion—App. No. PCT/US2020/063540.

Jun. 5, 2014—Cheong Pedro et al: "Yagi-Uda Antenna for Multi band Radar Applicat", IEEE Antennas and Wireless Propagation Letters, vol. 13' Jun. 5, 2014 (Jun. 5, 2014), pp. 1065-1068, XP011551009, ISSN: 1536-1225, DOI: 10 . 1109/LAWP.2014. 2328991 [retrieved on Jun. 13, 2014] abstract; figure 1 Chapter II.A. "Antenna configuration".

Dec. 10, 2016—Yang Deqiang et al: "Planar quasi-Yagi antenna with band rejection based on dual dipole structure for UWB", IET Microwaves, Antennas & Propagation, The Institution of Engineering and Technology, United Kingdom, vol. 10, No. 15, Dec. 10, 2016 (Dec. 10, 2016), pp. 1708-1714, XP006059471, ISSN: 1751-8725, DOI : 10.1049/IET-MAP.2016 .0160 abstract; figure 1 Chapter 2 "Antenna design".

* cited by examiner

DUAL BAND ANTENNA

CROSS-REFERENCE TO RELATED APPLICATIONS

The instant application is a continuation of U.S. patent application Ser. No. 16/727,631, titled "Dual Band Antenna" and filed Dec. 26, 2019, the disclosure of which is hereby incorporated by reference in its entirety.

FIELD

The disclosure relates to antennas for use in a wireless receiving or transmitting system, including wireless microphones, Wi-Fi applications, or cellular phones.

BACKGROUND

Modern wireless communication networks often require devices to operate in multiple frequency bands. For example, wireless local area networks (WLANs) using Wi-Fi standards commonly utilize frequency bands at 2.4 GHz and 5 GHz. Each of these frequency bands will have a certain width, for example, between 100 MHz and 150 MHz. As these networks become larger, multiple issues present themselves. For example, long cable runs between non-wireless network devices attenuate the signal as it is received at or from a wireless device. As another example, wirelessly transmitted signals are attenuated due to shadowing areas and interference from nearby sources like other Wi-Fi networks, computers, or products operating in the same frequency bands. To overcome these issues, antennas with high gain, a measure of an antenna's directionality and electrical efficiency, are often used. However, current examples of antennas used in dual band applications (e.g., printed dipole antennas or slot-monopole antenna) have omnidirectional radiation patterns. Conversely, many directional dual band antennas are optimized for one frequency band at the expense of other. Therefore, a need arises for a directional dual band antenna that is optimized for each frequency band.

SUMMARY

The following presents a simplified summary of the disclosure in order to provide a basic understanding of some aspects of the disclosure. This summary is not an extensive overview of the disclosure. It is not intended to identify key or critical elements of the invention or to delineate the scope of the invention. The following summary merely presents some concepts of the disclosure in a simplified form as a prelude to the more detailed description provided below.

Aspects of this disclosure relate to an antenna for use in a wireless system operating in two different frequency bands, including industrial, scientific, and medical (ISM) radio bands such as those used for Wi-Fi or cellphones. The frequency bands can also include ultra high frequency (UHF) bands and those used for digital enhanced cordless telecommunications (DECT).

With another aspect of this disclosure, the performance in each frequency band of a dual band antenna can be independently optimized. For example, by adjusting the size of certain elements of the antenna based on the frequencies of interest, the performance of the antenna can be improved in one frequency band while having minimal effects to the performance of the antenna in the other frequency band.

With another aspect of this disclosure, an antenna can be designed to operate in two different frequency bands while only needing a single feed line. This allows a wireless device to operate in two different frequency bands with a single antenna.

With another aspect of this disclosure, an antenna can be designed that is passive, meaning the antenna does not have any components that require power. This allows a wireless device with a transceiver to use a single antenna and change between transmitting and receiving without requiring any electronic switching.

BRIEF DESCRIPTION OF THE DRAWINGS

A more complete understanding of the present disclosure and the advantages thereof may be acquired by referring to the following description in consideration of the accompanying drawings, in which like reference numbers indicate like features, and wherein.

DETAILED DESCRIPTION

In the following description, reference is made to the accompanying drawings, which form a part hereof, and in which is shown by way of illustration various examples in which aspects may be practiced. References to "embodiment," "example," and the like indicate that the embodiment(s) or example(s) of the invention so described may include particular features, structures, or characteristics, but not every embodiment or example necessarily includes the particular features, structures, or characteristics. It is contemplated that certain embodiments or examples may have some, all, or none of the features described for other examples. And it is to be understood that other embodiments and examples may be utilized and structural and functional modifications may be made without departing from the scope of the present disclosure.

Unless otherwise specified, the use of the serial adjectives, such as, "first," "second," "third," and the like that are used to describe elements, are used only to indicate different elements that can be similar. But the use of such serial adjectives are not intended to imply that the elements must be provided in given order, either temporally, spatially, in ranking, or in any other way.

Also, the terms "front," "back," "side," "top," "bottom," "parallel," "perpendicular," "horizontal," "vertical," and the like, as well as descriptions in relation to axes, may be used in this specification to describe various example features and elements. But these terms are used herein as a matter of convenience, for example, based on the example orientations shown in the figures and/or the orientations in typical use. Nothing in this specification should be construed as requiring a specific three dimensional or spatial orientation of structures in order to fall within the scope of the claims.

Figure 1A:
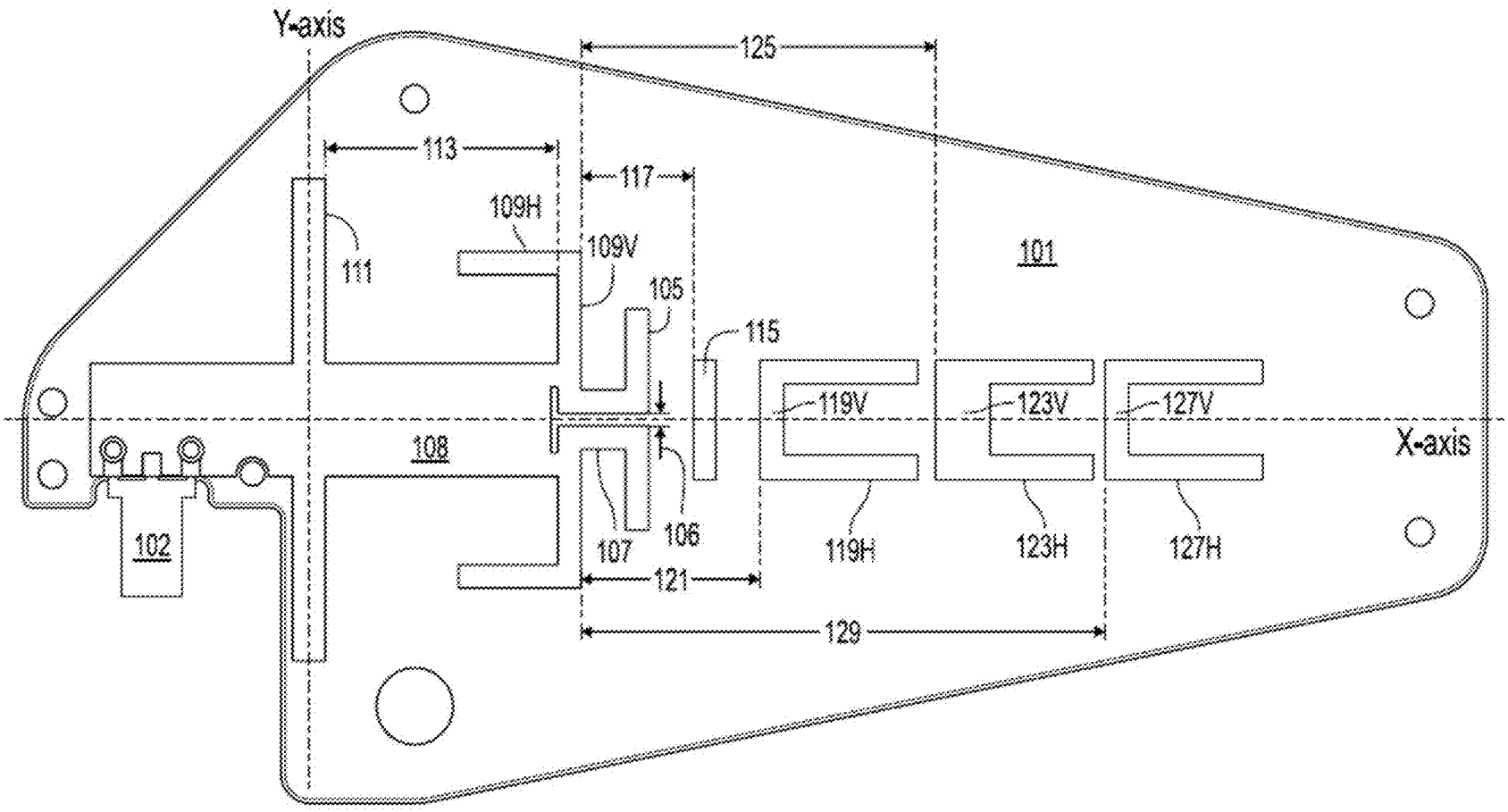
FIG. 1A shows a schematic of a top view of an example antenna according to an aspect of this disclosure.
Figure 1B:
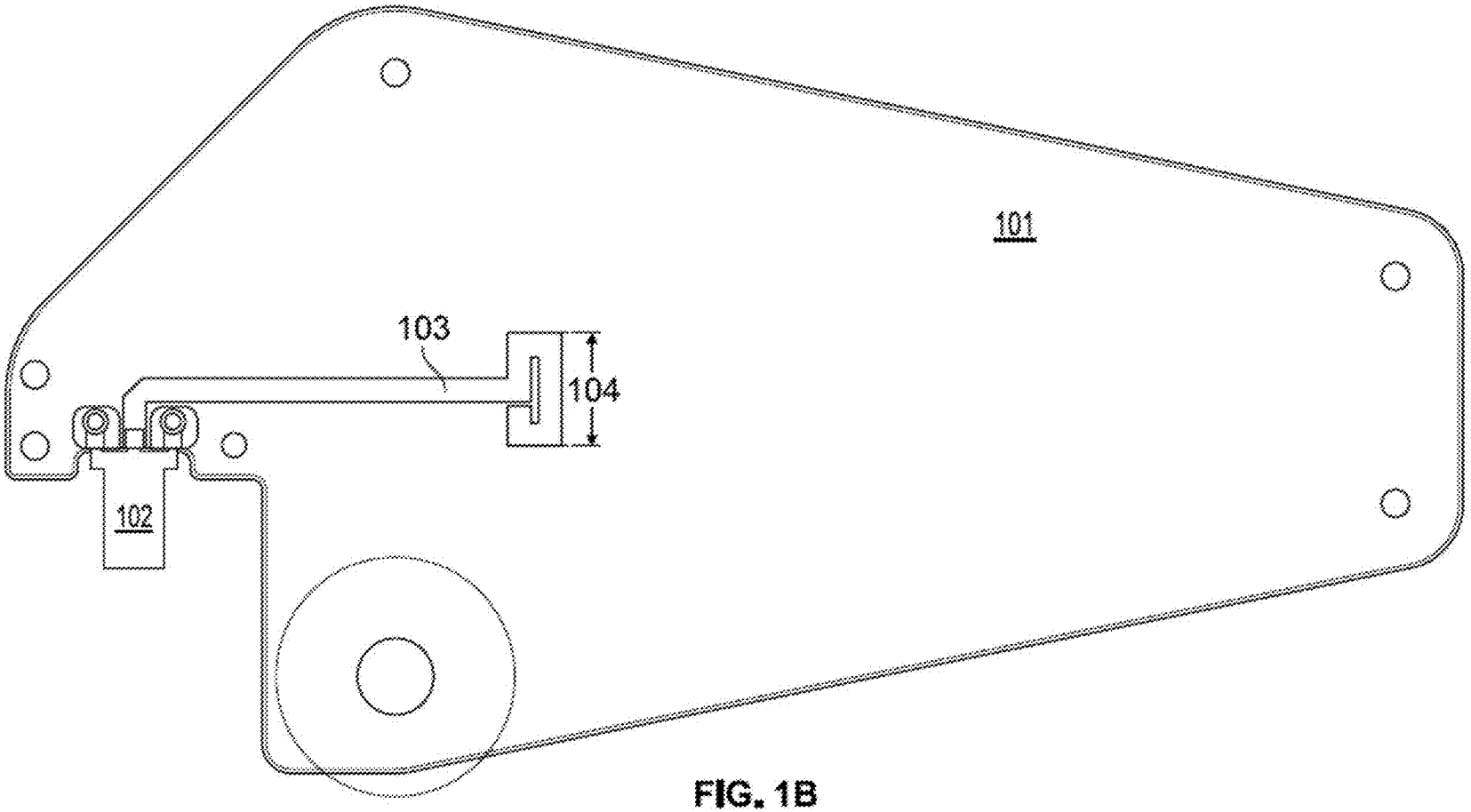
FIG. 1B shows a schematic of a bottom view of the example antenna of FIG. 1A.

FIG. 1A shows a schematic of a top view of an example antenna 101, while FIG. 1B shows a schematic of a bottom view the same antenna. Antenna 101 is a printed, planar antenna. These type of antennas are typically printed on circuit boards (PCBs) made of a low loss dielectric (e.g., FR-4). One advantage of this type of construction is the ability to manufacture antennas that are smaller in size and lower in cost.

In FIG. 1A, antenna 101 is symmetrical to the x-axis. For clarity, elements with the same number are electrically connected to each other (e.g., 109V and 109H). Elements with the suffix "V" are perpendicular to the x-axis, while elements with the suffix "H" are parallel with the x-axis. To the extent an element is placed fully above or below the x-axis (e.g., element 105), a matching element appears on the opposite side of the x-axis. Unless called out specifically, this specification will only reference the numerated element and not the matching element, but the description applies to both the numerated element and its matching element.

In FIG. 1A, a ground structure is formed, in part, by conductive elements 105, 107, 108, 109V, and 109H. These elements, via a main conductive element or main line 108, are connected to the shield of a coaxial connector 102. In this example, the main line 108 is 12.5 mm wide. These elements are driven by a conductive element or feed line 103 in FIG. 1B as it crosses under the gap 106. The elements of antenna 101 on the top of the PCB in FIG. 1A are separated from the feed line 103 by the thickness of the PCB, which in this example is 1.6 mm. The feed line 103 is connected to the center conductor of coaxial connector 102. This type of coupling is often referred to as slot coupling and transforms conductive elements 105, 107, 108, 109V, and 109H into driven elements or "drivers". The width of feed line 103 is determined by the dielectric constant and thickness of the PCB in order to achieve the desired transmission line impedance. In this example, the desired transmission line impedance is 50 ohms, and feed line 103 is 2.5 mm wide. The "hook" width 104 at the end of feed line is 6 mm. Gap 106 is the distance between element 107 and its matching element across the x-axis. The size of gap 106 is optimized to reduce the reactive components of the antenna's input impedance. In this example, gap 106 is 1.5 mm.

Element 105 and its matching element function as a dipole. Element 105 is the driver element for the high frequency band, meaning this element is responsible for facilitating either the receipt or transmission of the high frequency band. In this example, if the high frequency band is 5.5 GHz, element 105 has a length of 11.5 mm and width of 2.5 mm. Element 107 functions as a transmission line to feed element 105 and also functions to create space between elements 105 and 109V. The spacing between elements 105 and 109V is created by the length of element 107. This spacing and the length of element 109V is optimized to allow element 109V to function as a reflector element for the high frequency band element 105, meaning element 109V acts as a mirror to direct the energy of radiation of the high frequency band in the direction of the radiation pattern. In part, this reflector element 109V improves the front to back ratio (the ratio of power gain between the front and rear lobes of the antenna) and is how antenna 101 becomes a directional antenna. In this example in which the high frequency band is 5.5 GHz, element 107 has a length of 5 mm and width of 2.5 mm, while element 109V has a length of 18 mm and width of 2.5 mm.

Element 109V and its matching element function as a dipole. In addition to functioning as a reflector to element 105 for the high frequency band, element 109V functions as part of the driver element for the low frequency band, which in this example is the frequency band at 2.4 GHz. Element 109H also functions as part of the driver element for the low frequency band. In this example, element 109H is orthogonally connected to element 109V and has a length of 13.5 mm and width of 2.5 mm. By adjusting the size of element 109H, one can optimize and improve antenna 101's low frequency band performance with minimal effects on the performance in the high frequency band.

In FIG. 1A, element 111 is connected to main line 108 to improve antenna 101's gain and front to back ratio of the low frequency band by acting as a reflector. The spacing 113 and the length of element 111 maximize antenna 101's gain and front to back ratio in the low frequency band while minimally affecting the performance in the high frequency band. In this example, element 111 has a length of 20.5 mm and width of 3.8 mm, while spacing 113 is 26 mm. Element 111 is wider than other elements to improve the front to back ratio over a wider bandwidth in the 2.4 GHz band.

Figure 2:
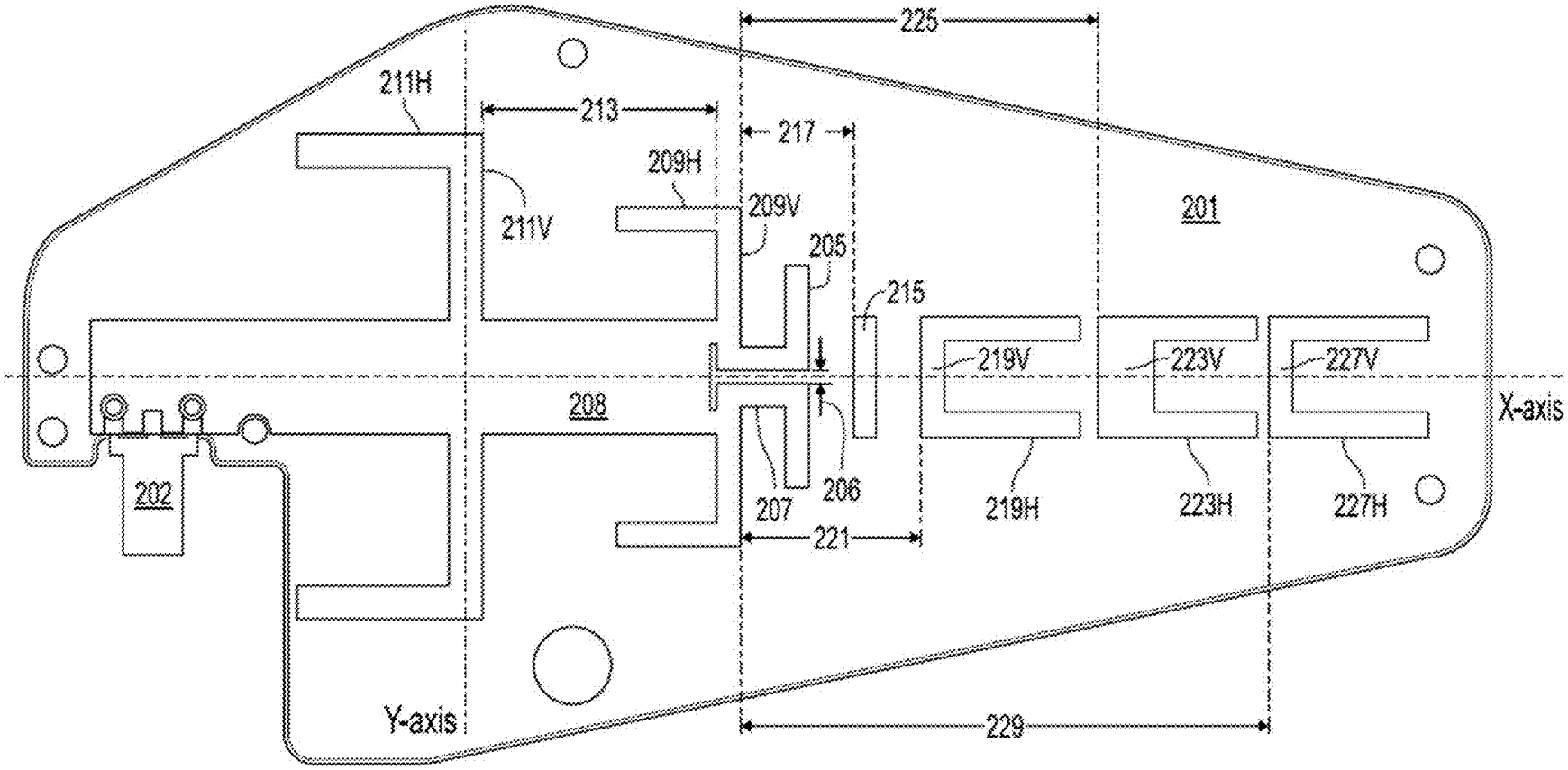
FIG. 2 shows a schematic of a top view of another example antenna according to an aspect of this disclosure.

To further improve front to back ratio, one may want to further increase the length of element 111, but size constraints do not allow this increase. FIG. 2 shows an alternative embodiment allowing this increase in size. Specifically, FIG. 2 shows a top view (similar to FIG. 1A) of alternative embodiment of the antenna 101 in which like reference numerals refer to the same or similar elements. However, in this example, antenna 201 includes element 211H. Element 211H connects orthogonally to element 211V. This increases the length of element 211V, and functionally alters its ability to act as a reflector, while not increasing the size of the antenna in the y-axis direction.

Another method to improve the antenna's front to back ratio, as well as the antenna's gain, includes adding parasitic elements. These parasitic elements, though conductive, are not electrically connected to the driven elements and function to alter the radiation in pattern of the antenna. In FIG. 1A, element 115 is a single conductive element that functions as a high frequency band director, improving antenna 101's gain and front to back ratio in the high frequency band. Here, with a high frequency band of 5.5 GHz, element 115 has a length of 13 mm and is placed 12.5 mm from element 109V (i.e., spacing 117). In this example, element 115 has a width 2.5 mm.

To further improve the antenna 101's gain and front to back ratio, additional parasitic elements can be added, as in FIG. 1A. Element 119V is a single conductive element that functions as a second high frequency band director. Element 119V has a length of 12.5 mm and placed 20 mm from element 109 (i.e., spacing 121). In this example, element 119V has a width 2.5 mm. Element 119H is connected orthogonally to element 119V. The combined length of elements 119V and 119H is optimized to functions as a low frequency band director, improving antenna 101's gain and front to back ratio in the low frequency band. Here, with a low frequency band of 2.4 GHz, element 119H has a length of 15 mm and width of 2.5 mm. The orthogonal nature of 119V and 119H allow one to adjust each element as needed to optimize performance for each frequency band of operation with a high degree of independence.

In FIG. 1A, additional parasitic elements 123V, 123H, 127V, and 127H are added to further improve the gain and front to back ratio of each frequency band. Element 123V has a length of 15 mm and width of 6 mm, and is 39.5 mm from element 109V (i.e. spacing 125). In this example, the width of 123V is slightly larger than many other of the elements of antenna 101. The width of elements has less effect on antenna performance, and if the elements are too wide, proper spacing between elements may be hard to achieve. Further, very small widths can both reduce the power handling capability of the antenna and the bandwidth of each operating bands. In this example, the width of element 123V is larger than the others to improve performance in the 2.4 GHz band, while spacing 125 is set to optimize 5.5 GHz performance. Making element 123V wider helped optimize operation in the 2.4 GHz band with minimal effects in the 5.5 GHz. Without this adjustment, spacing 125 would need to be increased to optimize 2.4 GHz performance at the expense of 5.5 GHz operation. Like element 119V, element 123V functions as a high frequency band director. Element 123H is connected orthogonally to element 123V and has a length of 11.5 mm and width of 2.5 mm. Again, the combined length of 123V and 123H functions as a low frequency band director, and the orthogonal nature of 123V and 123H allows one to adjust each element as needed to optimize antenna 101's performance for each frequency band of operation with a high degree of independence.

In a functionally similar fashion to elements 123V and 123H, elements 127V and 127H are added to antenna 101 to improve its gain and front to back ratio of each frequency band. Element 127V—again, a high frequency director—has a length of 15 mm and width of 2.5 mm, and is 58.5 mm from element 109V (i.e., spacing 129). Element 127H is connected orthogonally to element 127V and has a length of 15 mm and width of 2.5 mm. Elements 127H and 127V function as another low frequency director.

Thus, antenna 101 provides an example of a dual band directional antenna with a single feed that has been optimized for frequency, efficiency, gain, and front to back ratio for two frequency bands, one at 2.4 GHz and one at 5.5 GHz. The horizontal elements (e.g., those with suffixes "H") allow the independent optimization of the lower frequency band with minimal effects on the optimization of the higher frequency band. These horizontal or "bent" elements also make antenna 101 more compact. Further, antenna 101 is passive, meaning that it does not require power. This allows it to be used in a transceiver application and change between transmitting and receiving without requiring electronic switching.

Figure 3:
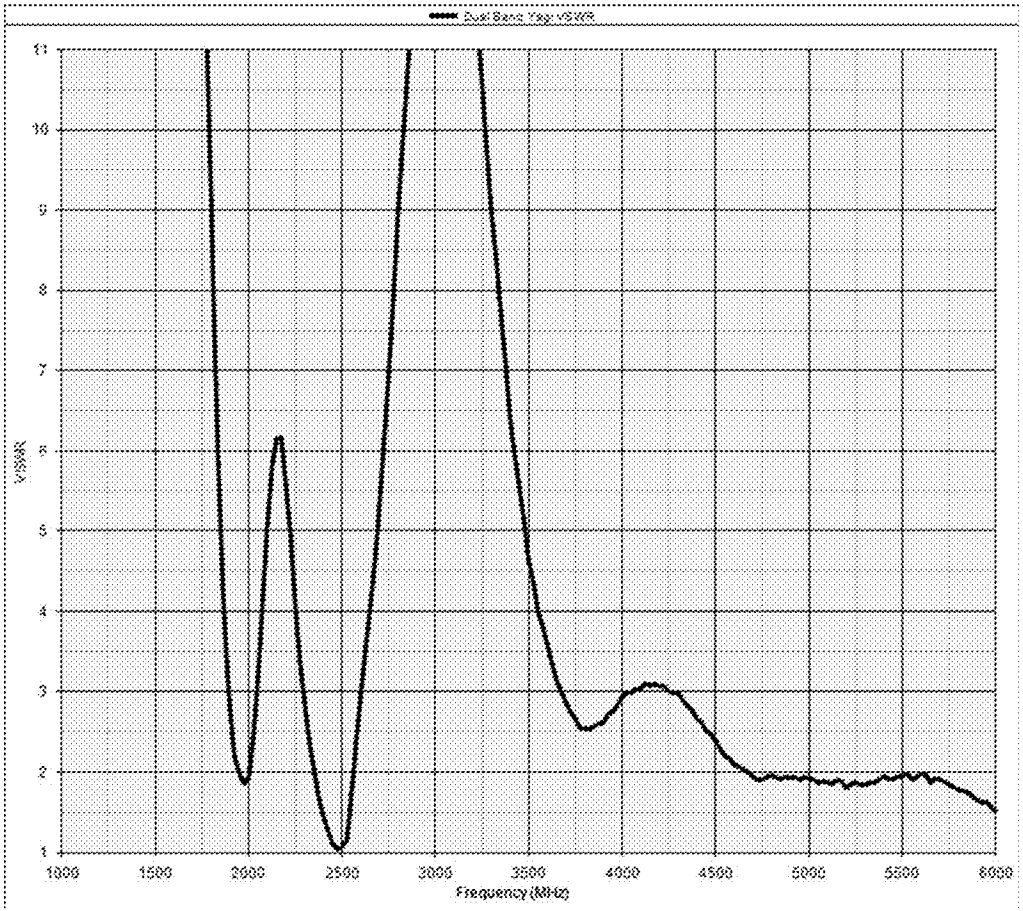
FIG. 3 illustrates a voltage standing wave ratio plot of the example antenna of FIG. 1A.

FIG. 3 illustrates a voltage standing wave ratio (VSWR) plot of antenna 101. This plot shows that antenna 101 has a low amount of power being reflected at 2.45 GHz and above 4.75 GHz. By having a low amount of reflected power at these frequencies, this plot indicates that antenna 101 has been designed to efficiently function at these frequencies and the two frequency bands of interest 2.45 GHz and 5.5 GHz, meaning a high percentage of power is transmitted at these frequencies rather than being reflected back at the transmitter.

Figure 4B:
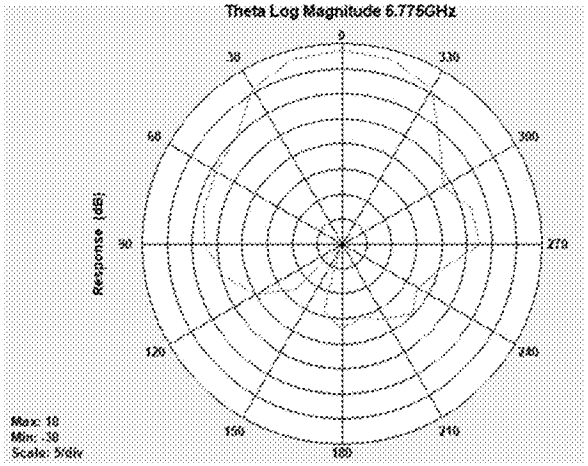
FIG. 4B illustrates a polar plot of the example antenna of FIG. 1A at 5.775 GHz.
Figure 4A:
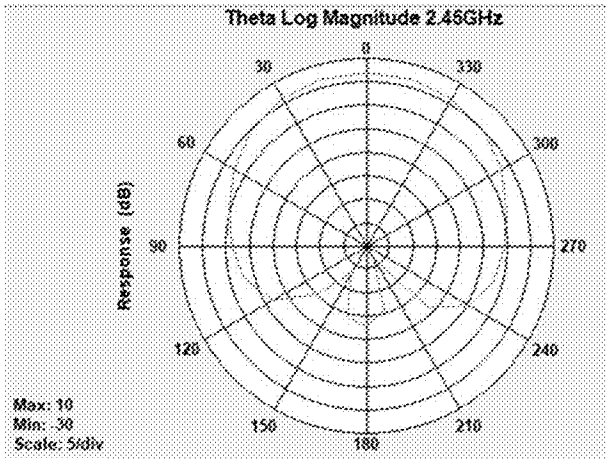
FIG. 4A illustrates a polar plot of the example antenna of FIG. 1A at 2.45 GHz.

FIGS. 4A and 4B illustrate polar plots of antenna 101 at frequencies 2.45 GHz and 5.775 GHz, respectively. The plots show the theta polarization component of the radiation pattern because that corresponds with the polarization of the radiated fields of antenna 101. At both frequency bands, antenna 101 shows strong directionality with little back radiation. This shows antenna 101 would be advantageous to use in instances when wirelessly transmitted signals must compete with transmitted signals from other sources like other Wi-Fi networks, computers, or products operating in the same frequency bands.

Figure 5A:
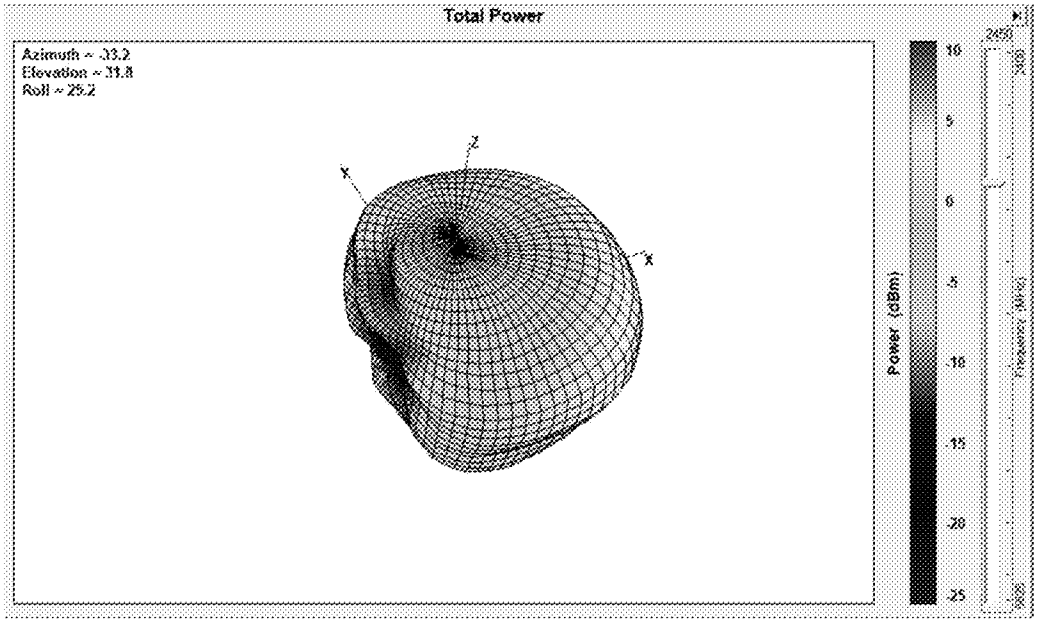
FIG. 5A illustrates the radiation pattern of the example antenna of FIG. 1A at 2.45 GHz.
Figure 5B:
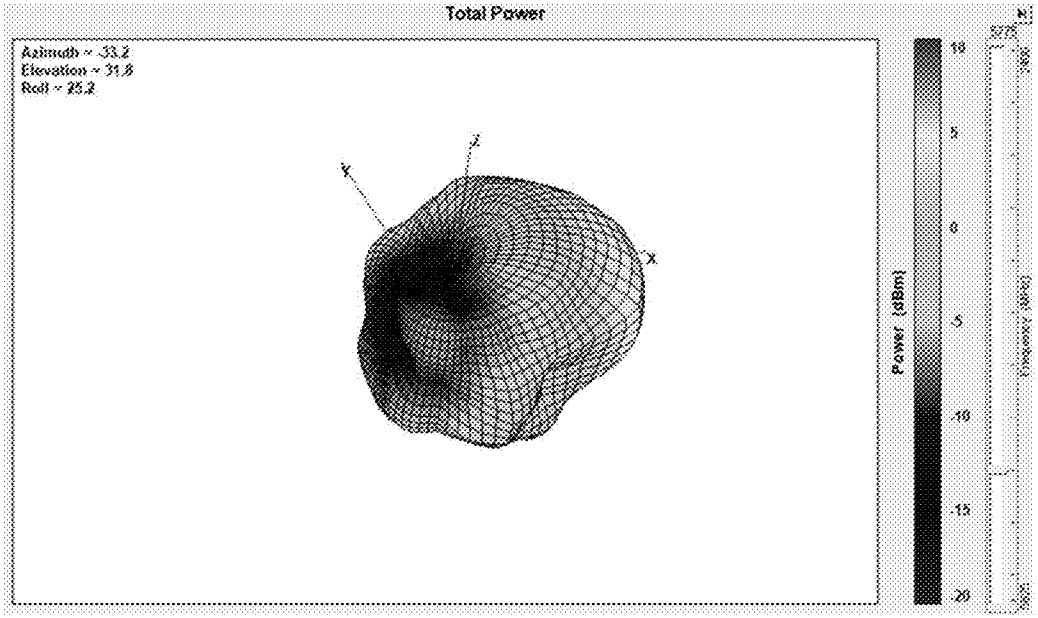
FIG. 5B illustrates the radiation pattern of the example antenna of FIG. 1A at 5.775 GHz.

FIGS. 5A and 5B illustrate the radiation pattern of antenna 101 at frequencies 2.45 GHz and 5.775 GHz, respectively. FIGS. 5A and 5B show that antenna 101 can transmit signals at these two frequencies with strong directionality and little back radiation. These radiation patterns also show that antenna 101 would be useful for wireless networks that require a directional dual-band antenna to overcome shadowing areas and interference from nearby wireless sources.

While antenna 101 was designed to cover frequency bands at 2.45 GHz and 5.5 GHz, other embodiments may support different dual frequency bands. For example, some embodiments may support a low UHF frequency band, high UHF frequency band, and/or cellular frequency band (e.g., 800 MHz, 900 MHz, 1800 MHz, or 1900 MHz). Consequently, some embodiments may support wireless applications different than Wi-Fi, such as wireless microphones, cell phones, or cordless phones. In choosing the frequency of bands, the higher frequency band is often approximately twice the frequency of the lower frequency band. The sizes of the antenna elements of these different embodiments will depend on the wave length of the frequency bands of interest. Additionally, one may alter the performance of antenna by chamfering or mitering the ends of the elements.

Another design consideration for the antenna includes the number and orientation of parasitic elements used. For instance, the horizontal and vertical elements do not necessarily have to be orthogonally connected; however, changing the angle of connection will make altering the sizes of these elements affect both frequency bands. Alternatively, if the size of the overall antenna is a limiting factor, one may include fewer parasitic elements, such as not including elements 123V, 123H, 127V, and 127H in antenna 101. Similarly, if one frequency band is more important than the other, elements can be added or eliminated. If, for instance, the high frequency band is more important, the horizontal elements (e.g., elements with the suffix "H" in antenna 101) of the passive elements may be eliminated, allowing the vertical elements more influence, which direct the high frequency band.

In another embodiment, an antenna comprises a main conductive element or main line, a conductive feed element or feed line, and a first pair of conductive elements or reflectors connected on opposite sides of the main conductive element. The antenna further comprises a second pair of conductive elements connected to a first end of the main conductive element. This second pair of conductive elements functions as a first pair of drivers and are parallel to the first pair of conductive elements. The antenna further comprises a third pair of conductive elements connected to the second pair of conductive elements distal to the main conductive element. This third pair of conductive elements functions as a second pair of drivers, and together with the first pair of drivers, is configured to operate in a first frequency band. The antenna further comprises a fourth pair of conductive elements that function as transmission lines and are connected to the second pair of conductive elements proximal to the main conductive element. The antenna further comprises a fifth pair of conductive elements that are connected to the fourth pair of conductive elements and are parallel to the second pair of conductive elements. This fifth pair of conductive elements functions as a third pair of drivers and is configured to operate in a second frequency band. The antenna further comprises a first single conductive element that functions as a director and is placed distal to the main conductive element and a distance separated from the fifth pair of conductive elements. This first single conductive element is also parallel to the fifth pair of conductive elements. The antenna further comprises a second single conductive element that functions as a second director and is placed a distance separated from the first single conductive element so that the first single conductive element is between the fifth pair of conductive elements and the second single conductive element. This second single conductive element is also parallel to the first single conductive element. The antenna further comprises a sixth pair of conductive elements, wherein each conductive element of the sixth pair of conductive elements is connected to opposite ends of the second single conductive element. This sixth pair of conductive elements function as directors.

Finally, although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A directional antenna comprising:

a main element;

a pair of reflector elements connected to the main element and configured to improve the directionality of the antenna in a first frequency band;

a first pair of driver elements connected to an end of the main element, wherein the first pair of driver elements is parallel to the pair of reflector elements and is configured to operate in a second frequency band; and a second pair of driver elements connected to the main element between the pair of reflector elements and the first pair of driver elements, wherein the second pair of driver elements is configured to operate in the first frequency band, and wherein each element of the second pair of driver elements includes a right angle that is positioned between the ends of each element of the second pair of driver elements so that a portion of each element of the second pair of driver elements is parallel to the pair of reflector elements and the portion of each element of the second pair of driver elements is configured to improve the directionality of the antenna in the second frequency band.

2. The directional antenna of claim 1, wherein the main element, the pair of reflector elements, the first pair of driver elements, and the second pair of driver elements are coplanar.

3. The directional antenna of claim 1, wherein the main element, the pair of reflector elements, the first pair of driver elements, and the second pair of driver elements are printed on a dielectric material.

4. The directional antenna of claim 1, wherein the pair of reflector elements are connected to the main element at right angles and on opposite sides of the main element.

5. The directional antenna of claim 1 further comprising a director element placed a distance separated from the first pair of driver elements, wherein the director element is parallel to the pair of reflector elements and is configured to improve the directionality of the antenna in the second frequency band.

6. The directional antenna of claim 5 further comprising at least one additional director element, wherein the at least one additional director element comprises:

a first sub-element parallel to the pair of reflector elements and configured to improve the directionality of the antenna in the second frequency band; and two additional sub-elements connected to opposite ends of the first sub-element at right angles and configured to improve the directionality of the antenna in the first frequency band.

7. The directional antenna of claim 6 wherein the at least one additional director element comprises at least three additional director elements.

8. A method of making a directional antenna comprising:

printing a main element;

printing a pair of reflector elements connected to the main element configured to improve the directionality of the antenna in a first frequency band;

printing a first pair of driver elements connected to an end of the main element, wherein the first pair of driver elements is parallel to the pair of reflector elements configured to operate in a second frequency band; and printing a second pair of driver elements connected to the main element between the pair of reflector elements and the first pair of driver elements, configuring the second pair of driver elements to operate in the first frequency band, and wherein each element of the second pair of driver elements includes a right angle that is positioned between the ends of each of the second pair of driver elements so that a portion of each of the second pair of driver elements is parallel to the pair of reflector elements and the portion of each element of the second pair of driver elements is configured to improve the directionality of the antenna in the second frequency band.

9. The method of claim 8, wherein the main element, the pair of reflector elements, the first pair of driver elements, and the second pair of driver elements are printed in the same plane.

10. The method of claim 8, wherein the main element, the pair of reflector elements, the first pair of driver elements, and the second pair of driver elements are printed on a dielectric material.

11. The method of claim 8, wherein the pair of reflector elements are printed so that the pair of reflector elements are connected to the main element at right angles and on opposite sides of the main element.

12. The method of claim 8 further comprising printing a director element a distance separated from the first pair of driver elements, wherein the director element is parallel to the pair of reflector elements and is configured to improve the directionality of the antenna in the second frequency band.

13. The method of claim 12 further comprising printing at least one additional director element, wherein the at least one additional director element comprises:

a first sub-element parallel to the pair of reflector elements and configured to improve the directionality of the antenna in the second frequency band; and two additional sub-elements connected to opposite ends of the first sub-element at right angles and configured to improve the directionality of the antenna in the first frequency band.

14. The method of claim 13, wherein the at least one additional director element comprises at least three additional director elements.

15. A directional antenna comprising:

a main element;

a feed element;

a pair of reflector elements connected to the main element and configured to improve the directionality of the antenna in a first frequency band;

a first pair of driver elements connected to an end of the main element, wherein the first pair of driver elements is parallel to the pair of reflector elements and is configured to operate in a second frequency band;

a director element placed a distance separated from the first pair of driver elements, wherein the director element is parallel to the pair of reflector elements and is configured to improve the directionality of the antenna in the second frequency band; and a second pair of driver elements connected to the main element between the pair of reflector elements and the first pair of driver elements, wherein the second pair of driver elements is configured to operate in the first frequency band, and wherein each element of the second pair of driver elements includes a right angle that is positioned between the ends of each of the second pair of driver elements so that a portion of each of the second pair of driver elements is parallel to the pair of reflector elements and the portion of each element of the second pair of driver elements is configured to improve the directionality of the antenna in the second frequency band.

16. The directional antenna of claim 15, wherein the main element, the pair of reflector elements, the first pair of driver elements, the director element, and the second pair of driver elements are coplanar.

17. The directional antenna of claim 16, wherein the main element, the pair of reflector elements, the first pair of driver elements, the director element, and the second pair of driver elements are printed on a first side of a dielectric material.

18. The directional antenna of claim 17, wherein the feed element is printed on a second side of the dielectric material.

19. The directional antenna of claim 18 further comprising at least one additional director element, wherein the at least one additional director element comprises:

a first sub-element parallel to the pair of reflector elements and configured to improve the directionality of the antenna in the second frequency band; and two additional sub-elements connected to opposite ends of the first sub-element at right angles and configured to improve the directionality of the antenna in the first frequency band.

20. The directional antenna of claim 19, wherein the at least one additional director element is coplanar with the main element, the pair of reflector elements, the first pair of driver elements, the director element, and the second pair of driver elements.

* * * * *